US010066891B2

(12) United States Patent
Iwasawa

(10) Patent No.: US 10,066,891 B2
(45) Date of Patent: Sep. 4, 2018

(54) CENTERING DEVICE FOR MOUNTING BARREL

(71) Applicant: TOKYO MARUI CO, LTD., Tokyo (JP)

(72) Inventor: Iwao Iwasawa, Tokyo (JP)

(73) Assignee: TOKYO MARUI CO., LTD., Tokyo (JP)

( * ) Notice: Subject to any disclaimer, the term of this patent is extended or adjusted under 35 U.S.C. 154(b) by 0 days.

(21) Appl. No.: 15/572,519

(22) PCT Filed: May 12, 2015

(86) PCT No.: PCT/JP2015/063661
§ 371 (c)(1),
(2) Date: Nov. 8, 2017

(87) PCT Pub. No.: WO2016/181505
PCT Pub. Date: Nov. 17, 2016

(65) Prior Publication Data

US 2018/0128568 A1 May 10, 2018

(51) Int. Cl.
*F41A 21/48* (2006.01)
*F41B 11/70* (2013.01)

(52) U.S. Cl.
CPC ..... *F41A 21/487* (2013.01); *F41A 21/48* (2013.01); *F41B 11/70* (2013.01)

(58) Field of Classification Search
CPC ..... F41A 21/487; F41A 21/484; F41A 21/48
USPC ..... 42/75.02, 75.01
See application file for complete search history.

(56) References Cited

U.S. PATENT DOCUMENTS 5,706,599 A * 1/1998 Knight ..... F41A 21/485 42/124
6,250,198 B1 * 6/2001 Vendetti ..... F41A 21/08 42/75.02
8,931,198 B2 * 1/2015 Aalto ..... F41A 21/48 42/75.02

FOREIGN PATENT DOCUMENTS

| | | |
|---|---|---|
| GB | 434220 | 8/1935 |
| JP | 2000-121292 | 4/2000 |
| JP | 3121574 | 5/2006 |

(Continued)

OTHER PUBLICATIONS

International Search Report dated Jul. 28, 2015.

*Primary Examiner* — Reginald S Tillman, Jr.
(74) *Attorney, Agent, or Firm* — Jacobson Holman, PLLC.

(57) ABSTRACT

A gun body includes a gun body side connection portion, a barrel includes a barrel side connection portion, and the gun body side connection portion and the barrel side connection portion are connected to each other by an insertion structure. The gun body side connection portion includes an inner peripheral surface which is formed inward from a connection opening, the barrel side connection portion includes an outer peripheral surface, at least one of the inner peripheral surface and the outer peripheral surface is formed in a tapered shape, and the other of the inner peripheral surface and the outer peripheral surface is formed in a shape which is movable along the tapered shape. The gun body side connection portion and the barrel side connection portion are drawn in a direction along a center line by coupling means, the inner peripheral surface or the outer peripheral surface having the tapered shape and the movable shape are fitted to each other, and the barrel is centered.

2 Claims, 6 Drawing Sheets

(56) References Cited

FOREIGN PATENT DOCUMENTS

JP 2013076526 4/2013

* cited by examiner

CENTERING DEVICE FOR MOUNTING BARREL

BACKGROUND OF THE INVENTION

The present invention relates to a center device for mounting a barrel which is used when a barrel is mounted on a gun body.

BACKGROUND ART

In the present invention, guns imitating real guns and guns without killing ability are collectively referred to as simulation guns. There are various kinds of simulation guns, and the simulation guns are mainly targeted for hobbies. However, currently, the simulation guns are widely used as substitutes for real guns in exercises or the like in various organizations, institutions, or the like. In the case of the simulation gun, for example, there is a model gun or the like not aiming to fire a bullet, as well as a gas gun which uses a high-pressure gas, an air gun which uses compressed air, an electric gun which obtains compressed air with a piston, or the like to fire bullet, and types and product development of the simulation gun are extensive.

Any type of gun has a barrel, that is, a gun barrel, in a case where the barrel is made of a separate member from a gun body and is mounted on the gun body, as a matter of course, the barrel should be correctly mounted on the gun body. Rather, it is generally recognized that the barrel is centered. However, in a case where machining accuracy of a mounting portion of the gun body side and the barrel is not sufficient, the mounted barrel is likely to be inclined or rattled. Under such circumstances, it is not possible to fire a bullet satisfactorily and the gun will not be become a product.

In the related art, each company manufactures simulation guns with high accuracy. However, it is not always for manufacturers of simulation guns to sustain their efforts. Prior to the filling of the present application, the present applicant searched the prior art, but no reference was found. For example, Japanese Unexamined Patent Application, Publication No. 2000-121292 is an invention aimed to improving accuracy of hitting, in which a barrel is mounted and fixed by a washer at a rear portion, and a center of the barrel and a center of a nozzle coincide with each other. In addition, Japanese Unexamined Patent Application, Publication No. 2000-121292 discloses that the barrel may be fixed by a screw structure without using the washer. However, in Japanese Unexamined Patent Application, Publication No. 2000-121292, nothing can be found about a new proposal for centering.

PATENT LITERATURE

Japanese Unexamined Patent Application, Publication No. 2000-121292

BRIEF SUMMARY OF THE INVENTION

Technical Problem

The present invention is made in consideration of the above-described circumstances, and an object thereof is to perform correct centering of a barrel without generating inclination or rattling even in a state where a special precision device or method for assembling or the like is not prepared. In addition, another object of the present invention is to provide a device capable of performing correct centering of a barrel in a process of assembling component such as the barrel.

Solution to Problem

In order to achieve the objects, according to an aspect of the present invention, there is provided a centering device for mounting a barrel which is applied when a barrel is mounted on a gun body, in which the gun body includes a gun body side connection portion, the barrel includes a barrel side connection portion, and the gun body side connection portion and the barrel side connection portion are connected to each other by an insertion structure, the gun body side connection portion includes an inner peripheral surface which is formed inward from a connection opening, the barrel side connection portion includes an outer peripheral surface which is formed to be fitted to the inner peripheral surface, at least one of the inner peripheral surface and the outer peripheral surface is formed in a tapered shape, and the other of the inner peripheral surface and the outer peripheral surface is formed in a shape which is movable along the tapered shape, and the gun body side connection portion and the barrel side connection portion are drawn in a direction along a center line by coupling means, the inner peripheral surface or the outer peripheral surface having the tapered shape and the movable shape are fitted to each other, and the barrel is centered.

In addition, in general, the barrel means a gun barrel which fires a bullet. The gun barrel is not limited to a single member, and some of gun barrels have a double structure configured a portion (inner barrel) through which the barrel passes and a portion (outer barrel) disposed on an outer periphery of the inner barrel. In the present invention, the barrel is mainly applied to a barrel which is directly mounted on the gun body.

The centering device of the present invention is applied to a gun having a structure in which the barrel is mounted on the gun body, and thus, a center of the gun body side connection portion and a center of the barrel side connection portion coincide with each other. Accordingly, the barrel has the center like a cylinder and the gun body side connection portion similarly has the center. However, although whether or not a gun has a bullet firing function is important purpose for a centering, the bullet firing function is not indispensable. Therefore, for example, a light gun or the like is also an object of the present invention, and not only simulation guns but also real gun is the object of the present invention.

In the configuration, the gun body has the gun body side connection portion which is connected to the barrel by the insertion structure, and the barrel has the barrel side connection portion which is connected to the gun body side connection portion by the insertion structure. The gun body side connection portion and the barrel side connection portion need only be in a relationship to be inserted. In an embodiment described later, the connection portion of the barrel is inserted inside the connection opening of the gun body. However, the gun body side connection portion may be disposed inside the barrel side connection portion or the gun body side connection portion may be disposed outside the barrel side connection portion.

The gun body side connection portion includes an inner peripheral surface which is formed inward from the connection opening and the barrel side connection portion includes the outer peripheral surface which is formed to be fitted to the inner peripheral surface. At least one of the inner peripheral surface and the outer peripheral surface is formed in a tapered shape and the other of the inner peripheral surface and the outer peripheral surface is formed in a shape which is movable along the tapered shape. In this case, the other of the inner peripheral surface and the outer peripheral surface can be formed in a step shape, and the stepped portion comes into contact with the inner peripheral surface or the outer peripheral surface of the tapered shape.

Moreover, in a case where both the inner peripheral surface and the outer peripheral surface are formed in tapered shapes, the taper of the gun body side connection portion and the taper of the barrel side connection portion coincide with each other (becomes a state in which a surface contact is possible). As a result, the gun body side connection portion and the barrel side connection portion are drawn in the direction of the center line by the coupling means, and thus, the inner peripheral surface having the tapered shape or the outer peripheral surface having the tapered shape are fitted to each other, and the barrel is centered.

In the device of the present invention, preferably, the coupling means includes a gun body side connection portion provided with a male screw portion and a coupling ring having a female screw portion screwed to the male screw portion, and the coupling ring includes an engaging portion which engages with an engaging mating portion provided on an outer periphery of the barrel.

Moreover, preferably, both the gun body side connection portion and the barrel side connection portion have male and female fitting relationships, the barrel side connection portion configures a male side and has a split tubular collet configured of a member separated from the barrel and a portion for mounting the collet fastened to be fitted to the gun side connection portion which is a female side, the portion for mounting the collet has an elongated slit in a direction of a central axis of the barrel, and a direction of the slit coincides with a direction of the split tubular portion of the collet.

Advantageous Effects of Invention

The present invention is configured and operated as described above, and thus, even in a state where a special precision device or method for assembling or the like is not prepared, at least one of the gun body side connection portion and the barrel side connection portion is formed in a tapered shapes, and fitting is performed along the tapered shape. Accordingly, correction centering of the barrel is performed without generating inclination or rattling. In addition, according to the present invention, in a process in which a component of the device such as the barrel is assembled, it is possible to provide the device capable of performing correct centering of the barrel without waste.

BRIEF DESCRIPTION OF DRAWINGS

FIG. 3 consists of FIGS. 3A, 3B and 3C and is a view showing the state where the device is exploded.

FIG. 4 consists of FIG. 4A, 4B, 4C and shows a state where the device is assembled.

FIG. 5 consists of FIGS. 5A and 5B and shows Example 2 of the embodiments of the present invention.

FIG. 6 consists of FIGS. 6A and 6B and shows Example 3 of the embodiments of the present invention.

DETAILED DESCRIPTION OF THE EMBODIMENTS

Hereinafter, the present invention will be described in detail with reference to an embodiment shown. A centering device of the present invention is applied to all simulation guns and is not limited to a gas gun. However, for convenience, first, an outline of the gas gun will be described. In addition, a barrel of the embodiment corresponds to the above-described outer barrel.

Figure 1:
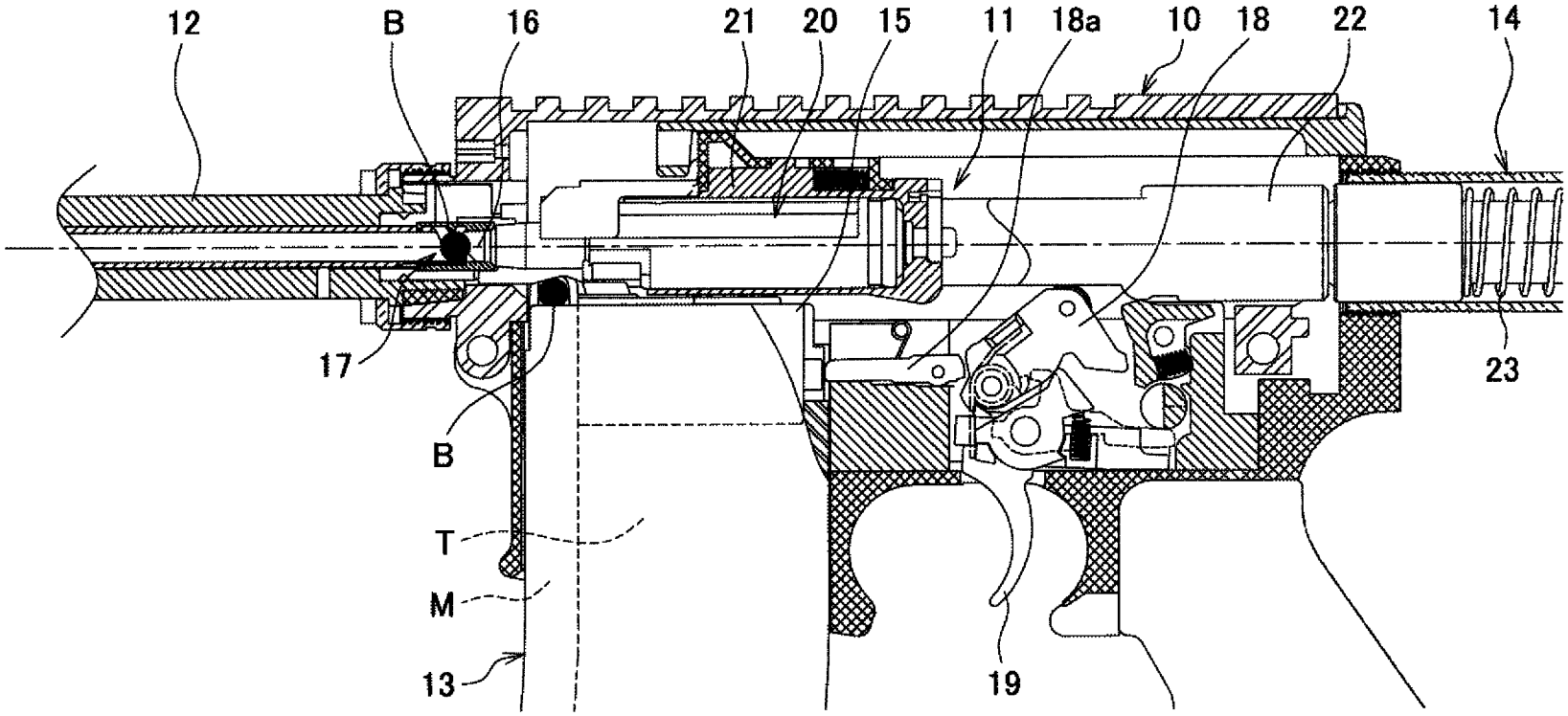
FIG. 1 is a sectional explanatory view showing an example in which a centering device for mounting a barrel according to the present invention is applied to a gas gun.

FIG. 1 shows an example in which a centering device for mounting a barrel according to the present invention is applied to the gas gun. In the gas gun, a firing set portion 11 is disposed at a gun body 10 positioned at a center portion of the gas gun, a barrel 12 is disposed in front of the gun body 10, a magazine portion 13 is disposed below the gun body 10, and a bolt assembly incorporating portion 14 is disposed behind the gun body 10. The magazine portion 13 is equipped with a magazine M which receives a spherical bullet B called a BB bullet, a tank T which filled with gas, and an on-off valve mechanism 15 for supplying gas.

In FIG. 1, the bullet B is loaded in the bullet portion 17 by moving a firing nozzle 16 forward, and the hammer 18 is also cocked. Therefore, by manipulating a trigger 19, the hammer 18 strikes the knocker 18*a* to open the on-off valve mechanism 15 so as to supply gas, and thus, the bullet B can be fired. In addition, the magazine portion 13 can be attached to and detached from the gun body 10, the magazine M is positioned in a front portion of the magazine portion 13, and the bullets B are pushed up toward the back of the bullet portion 17 one by one.

A reference numeral 20 indicates a piston mechanism portion, and according to opening of the on-off valve mechanism 15, the piston mechanism portion ejects gas to the bullet B positioned in the bullet portion 17 to fire the bullet B. In addition, the piston mechanism portion 20 is closed by a pressure of the gas which continuously flows into the piston mechanism portion 20 even after the bullet is fired, and the piston mechanism portion 20 moves a cylinder 21 backward and moves a bolt 22 integrated with the cylinder 21 backward.

The piston mechanism 20 is operated by a system called a differential pressure valve. Specifically, the invention of a control valve device described in Japanese Unexamined Patent Application, First Publication No. 2013-76526 is applied to the piston mechanism 20.

A reference numeral 23 indicates a buffer spring, which is provided to buffer a movement of the bolt 22 moving backward. The buffer spring 23 is compressed and accumulated during the buffering operation, and moves the withdrawn bolt 22 forward by the subsequent spring force. As a result, the piston mechanism 20 integrated with the bolt 22 is returned to the state of FIG. 1. However, the bullet B delivered therebetween is pushed into the bullet portion 17 by the nozzle 16.

Figure 2:
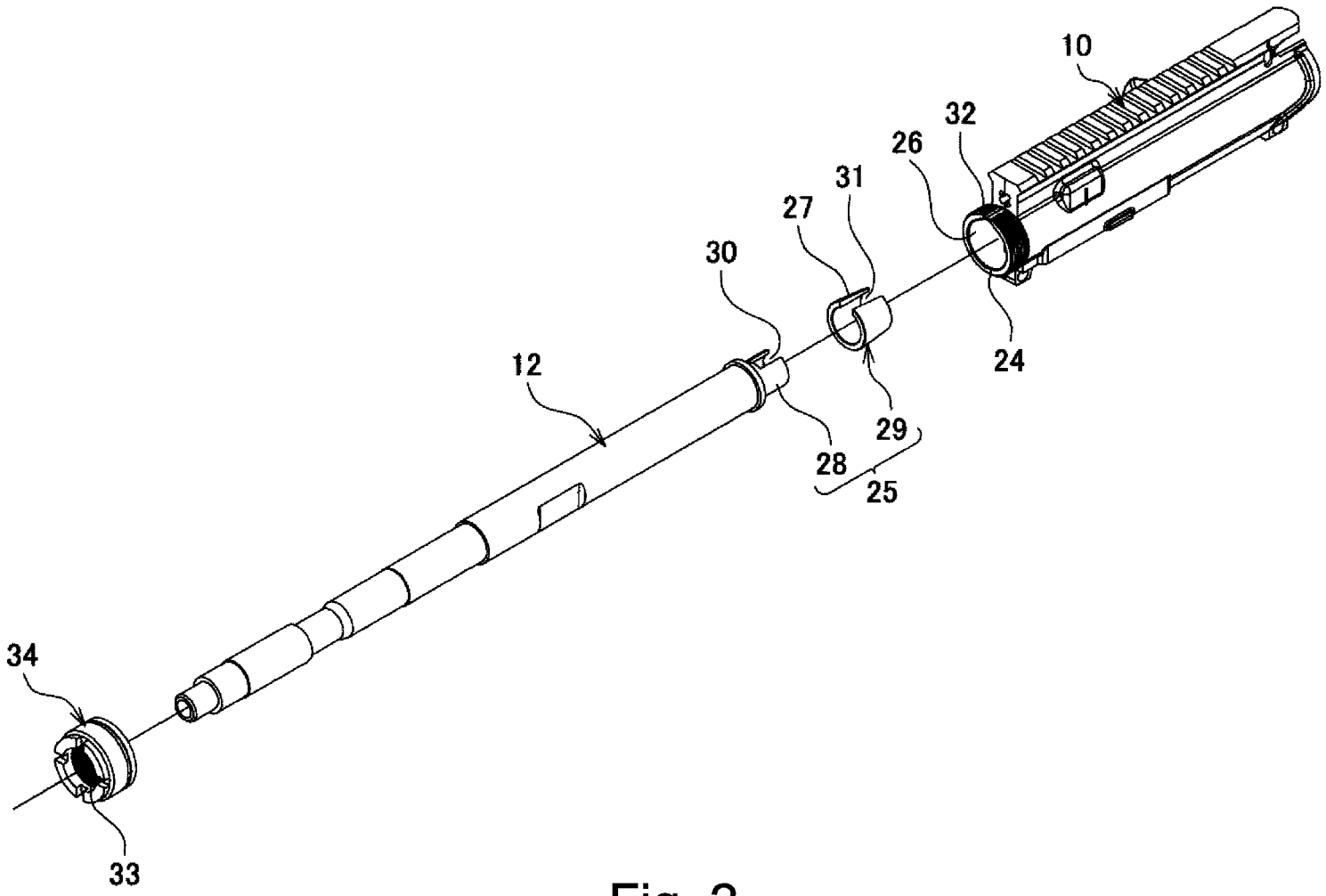
FIG. 2 is a perspective view showing a state where the device is exploded.
Figure 3A:
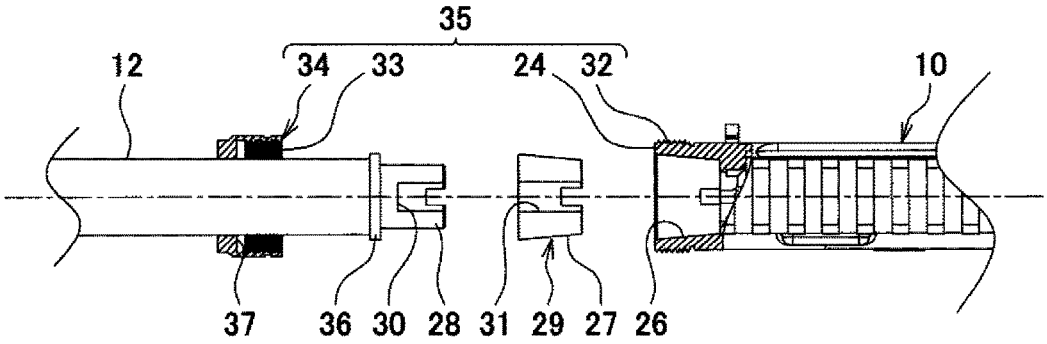
FIG. 3A is a top view showing a state where coupling means is broken.
Figure 3B:
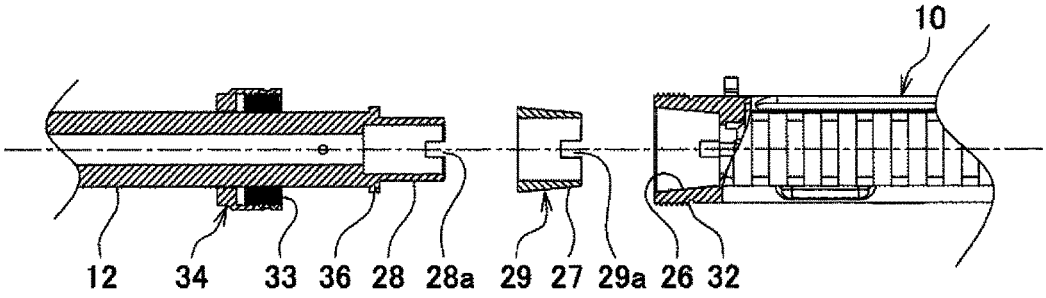
FIG. 3B is a top view showing a state where a barrel and a gun body side connection portion are broken.
Figure 3C:
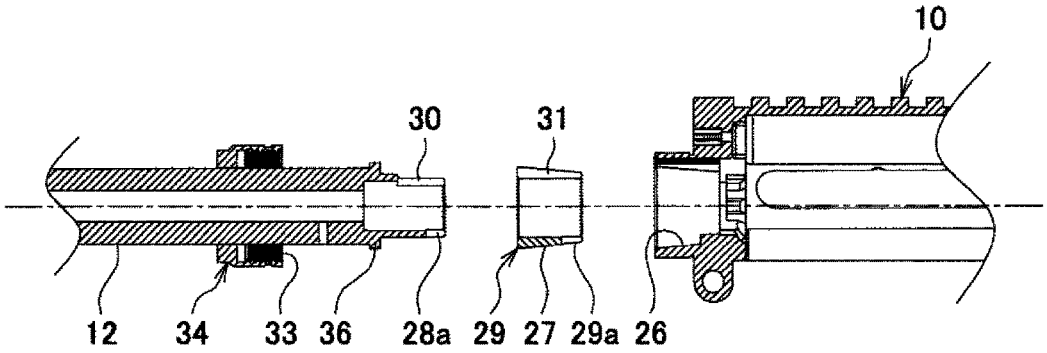
FIG. 3C is a similar side view showing a cross section different by 90° from FIG. 3B.
Figure 4A:
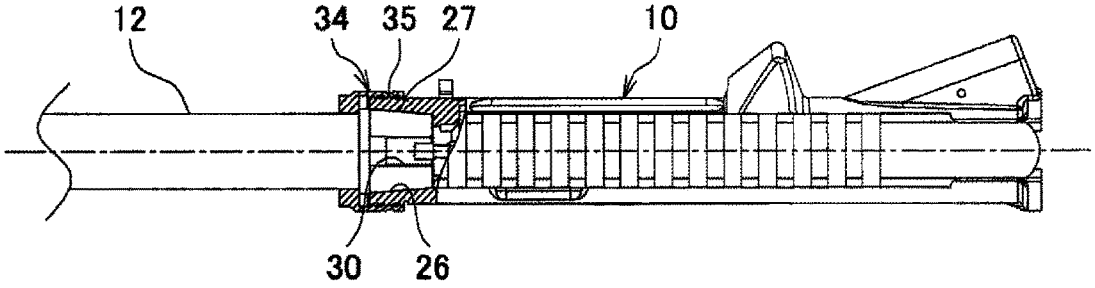
FIG. 4A is a top view showing a state where the portion of the coupling means is broken.
Figure 4B:
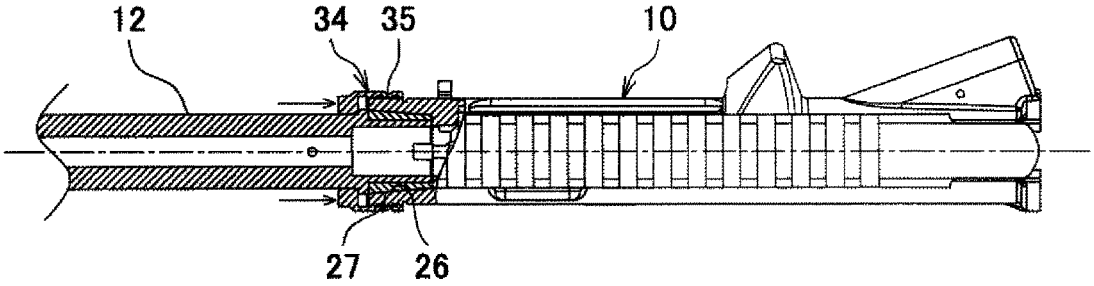
FIG. 4B is a top view showing a state where the barrel and the gun body side connection portion are broken.
Figure 4C:
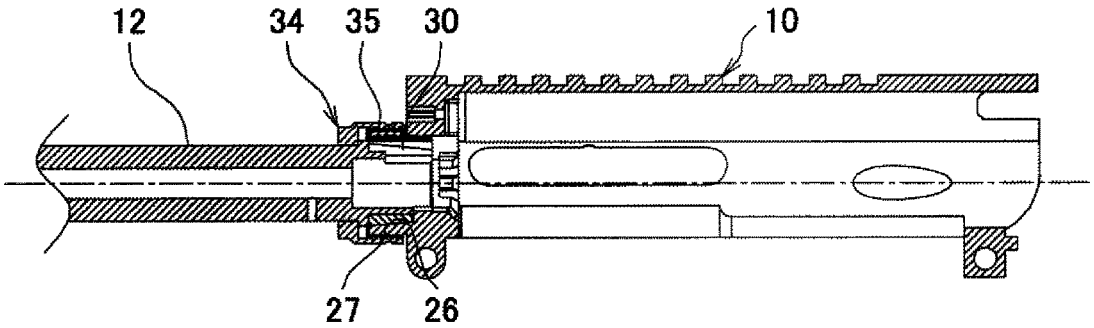
FIG. 4C is a similar side view showing a cross section different by 90° from FIG. 4B.

The gun body 10 to which the present invention is applied includes an opening which is a gun body side connection portion 24 on a front end of the gun body 10. Meanwhile, a connection portion 25 on the barrel 12 side is a portion on a rear end of the barrel 12. In this embodiment, as described above, the barrel side connection portion 25 is inserted into the connection portion 24 of the gun body (refer to FIG. 2). That is, the gun body side connection portion 24 and the barrel side connection portion 25 are in male and female fitting relationships, and the barrel side connection portion configures 25 male side.

The gun body side connection portion 24 has an inner peripheral surface 26 formed in a tapered shape inwardly from an opening end of a connection opening. Meanwhile, the barrel side connection portion 25 is also a portion having an outer peripheral surface 27 which is formed in a tapered shape to be fitted to the inner peripheral surface 26. Accordingly, Embodiment 1 shown in FIGS. 1 to 4 is an example of a case where the inner peripheral surface and the outer peripheral surface are formed in tapered shapes. However, in a case of the barrel side connection portion 25 shown as the embodiment in which it is not necessary to machine the barrel 12 to form the tapered shape of the outer peripheral surface 27, the barrel side connection portion 25 is configured of a rear end portion 28 of the barrel 12 and a split tubular collet 29 formed of a member separated from the rear end portion 28. Accordingly, the outer peripheral surface 27 is formed as an outer peripheral surface of the collet 29.

A portion for mounting the collet 29 is mounted is a rear end of the barrel side connection portion 25, the rear end includes an elongated slit 30 in a direction of a central axis of the barrel 12, and a direction of the slit 30 coincides with a direction of a split tubular portion 31 of the collet 29. In a natural state of the collet 29, the outer peripheral surface 27 is formed to have a slightly larger diameter than that of the inner peripheral surface 26 on the gun body side, an inner diameter of the collet 29 is formed to have a slightly larger diameter than that of the outer shape of the rear end portion 28 of the barrel 12, and as described later, the collet 29 is elastically deformed and tightened at the time of assembly.

The tapered shapes of the inner peripheral surface 26 and the outer peripheral surface 27 are designed such that the inner peripheral surface 26 having the tapered shape and the outer peripheral surface 27 having the tapered shape are fitted to each other and the barrel is centered when the assembly is completed. In the present invention, the inner peripheral surface 26 having the tapered shape and the outer peripheral surface 27 having the tapered shape being fitted to each other and the barrel being centered is referred to as taper fitting. In the taper fitting state, when the inner peripheral surface 26 and the outer peripheral surface 27 are fitted to each other and the barrel is centered, the inner peripheral surface 26 and the outer peripheral surface 27 come into substantially surface-contact with each other.

The gun body side connection portion 24 and the barrel side connection portion 25 are configured to be drawn in the direction of the center line by coupling means 35. The coupling means 35 includes the gun body side connection portion 24 provided with a male screw portion 32 and a coupling ring 34 having a female screw portion 33 screwed to the male screw portion 32 (refer to FIG. 3 or the like). The male screw portion 32 configures one of the coupling means 35 and is formed on an outer periphery of a circular frame portion of the gun body side connection portion 24.

The coupling ring 34 configuring the other of the coupling means is literally formed of a ring-shaped member and is fitted to the outer periphery of the barrel 12 from the tip. The coupling ring 34 has an engaging portion 37 disposed on the front side from the female screw portion 33, and the engaging portion 37 engages with an engaging mating portion 36 provided on the outer periphery of the barrel 12. The engaging mating portion 36 is formed at a boundary between the barrel 12 and the rear end portion 28. In addition, notch portions 28*a* and 29*a* coinciding with the direction of the split tubular portion 31 are respectively provided in the rear end portion 28 of the barrel 12 and the collet 29.

The centering device for mounting a barrel of the present invention is configured as described above, and centering can be performed by using the collet 29 to connect the barrel 12 to the gun body side connection portion 24. That is, the collet 29 is fitted to the rear end portion 28 of the barrel 12 such that the positions of the slit 30 and the tubular portion 31 are aligned with each other, and then, similarly, the barrel 12 is inserted into the gun body side connection portion 24 such that the positions of the collet 29 and the gun body side connection portion 24 are arranged with each other.

After the collet 29 is inserted into the gun body side connection portion 24, the coupling ring 34 is moved to the rear end of the barrel, and the female screw portion 33 and the male screw portion 32 of the gun body 10 are screwed to each other. As the screwing advances, the engaging portion 37 engages with the engaging mating portion 36, and according to this, the barrel 12 is drawn toward the gun body 10 (→ in FIG. 4B), the outer peripheral surface 27 of the collet 29 and the inner peripheral surface 26 on the gun body side come into contact with each other.

If the screwing of the coupling ring 34 further advances, a contact pressure between the outer peripheral surface 27 of the collet 29 and the inner peripheral surface 26 on the gun body side becomes stronger, and thus, the collet 29 slightly elastically deforms and tightens the rear end portion 28 of the barrel with a stronger compression force. In this way, while the gun body side connection portion 24 and the barrel side connection portion 25 are drawn in the direction of the center line by the coupling means 35, the inner peripheral surface 26 having the tapered shape and the outer peripheral surface 27 having the tapered shape are fitted to each other, and thus, the centering of the barrel 12 is completed.

Figure 5A:
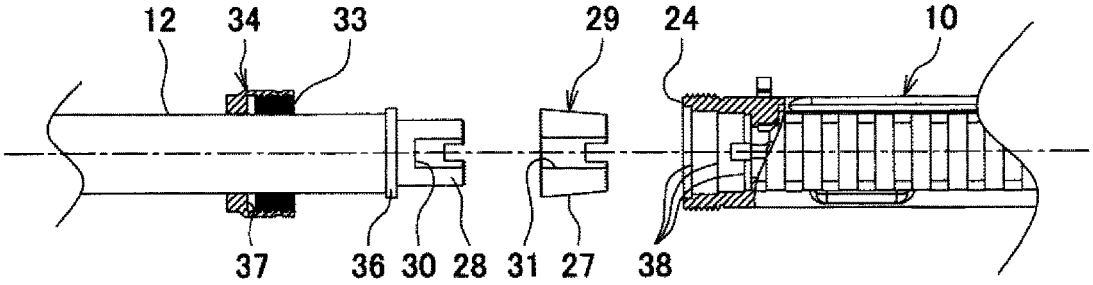
FIG. 5A is a top view a state where a device is exploded.
Figure 5B:
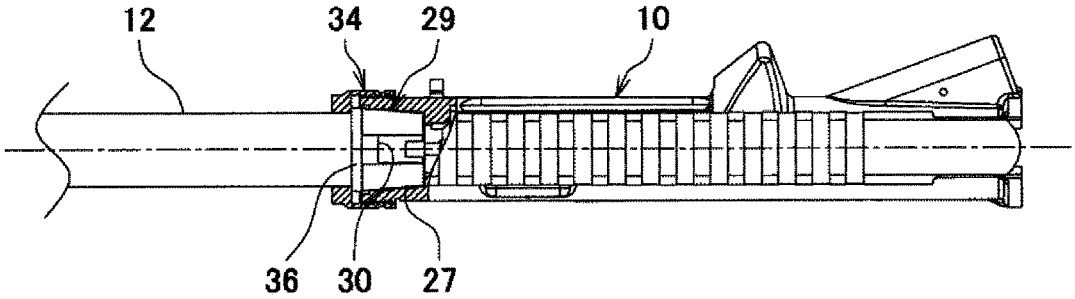
FIG. 5B is a top view showing a state where only a connection portion is broken.

Examples 2 and 3 of the embodiment will be described. Examples 2 and 3 are examples in which at least one of the inner peripheral surface 26 and the outer peripheral surface 27 is formed in a tapered shape and the other of the inner peripheral surface 26 and the outer peripheral surface 27 is formed in a shape which is movable along the tapered shape. In Example 2 shown in FIG. 5, the outer peripheral surface 27 of the collet 29 is formed in a tapered shape, and three stepped corners 38 having different opening diameters are formed on the inner peripheral surface 26 of the gun body side connection portion 24. The corners 38 having three steps come into contact with the outer peripheral surface 27 having the tapered shape in a movable manner.

In Example 2, the stepped corner 38 has three steps. However, the present invention is not limited to this. The corner 38 is formed in a step shape (inner diameter) which comes into contact with the inclined portion of the tapered shape. Accordingly, the collet 29 is fitted to the rear end portion 28 of the barrel 12 and is inserted into the gun body side connection portion 24 from the opening and the coupling ring 34 is screwed in the same manner as described above, and thus, the three stepped corners 38 and the outer peripheral surface 27 having the tapered shape are fitted to each other.

Figure 6A:
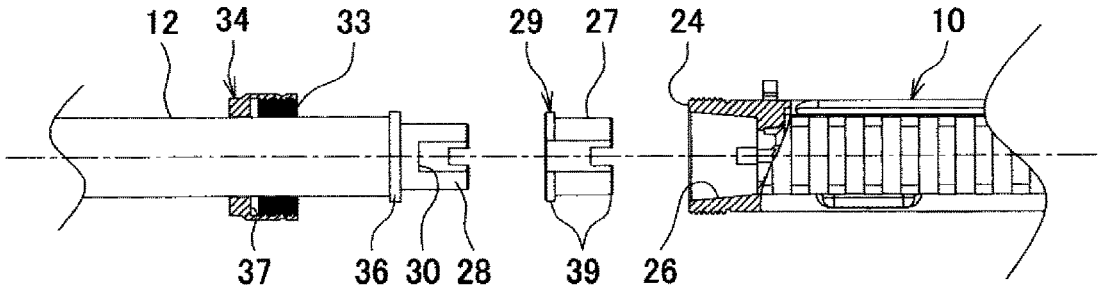
FIG. 6A is a top view showing a state where a device is exploded.
Figure 6B:
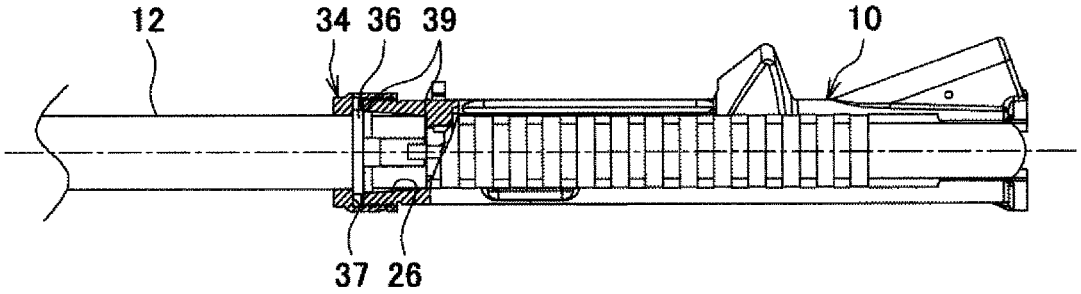
FIG. 6B is a top view showing a state where only a connection portion is broken.

In Example 3 of FIG. 6, the inner peripheral surface 26 of the gun body side connection portion 24 is formed in a tapered shape, portion having different outer diameters are provided on the outer peripheral surface 27 of the collet 29, and the inner peripheral surface 26 having a tapered shape forms a movable stepped corners 39. In the case of Example 3, since the number of stepped corners 39 is as small as two, Example 3 is most easily practicable, the coupling ring 34 is screwed to the gun body side in the same manner as described above, and thus, the barrel 12 is mounted on the gun body 10 while the centering the barrel 12 is not performed.

As described above, according to the present invention, the process of mounting the barrel 12 on the gun body 10 is also the process of centering the barrel 12, and all components for performing the centering are used to mount the barrel 12 on the gun body 10. Accordingly, it can be said that the present invention is an unprecedented new proposal which is not wasteful and cannot find similar technology in the field to which the present invention belongs.

REFERENCE NUMBER LIST

10: gun body
11: firing set portion
12: barrel
15: on-off valve mechanism
19: trigger
20: piston mechanism portion
21: cylinder
22: bolt
24: gun body side connection portion
25: barrel side connection portion
26: inner peripheral surface
27: outer peripheral surface
28: rear end portion of barrel
29: collet
30: slit
31: split tubular portion
32: male screw portion
33: female screw portion
34: coupling ring
35: coupling means
36: engaging mating portion
37: engaging portion
38, 39: stepped corner

The invention claimed is:

1. A gun comprising a barrel, a gun body, and a centering device for mounting the a barrel on the a gun body, wherein the gun body includes a gun body side connection portion, the barrel includes a barrel side connection portion, and the gun body side connection portion and the barrel side connection portion are connected to each other by an insertion structure, wherein the gun body side connection portion includes an inner peripheral surface that is formed inward from a connection opening, the inner peripheral surface forms stepped corners having different opening diameters, the barrel side connection portion includes an outer peripheral surface that is formed to be fitted to the inner peripheral surface, the outer peripheral surface is formed in a tapered shape, and the stepped comers and the outer peripheral surface are is-formed in a movable shape that enables the stepped corners and the outer peripheral surface to move along the tapered shape in touching each other, and wherein the gun body side connection portion and the barrel side connection portion are drawn in a direction along a center line by coupling means, wherein the coupling means consists of a gun body side connection portion having a male screw and a coupling ring having a female screw to screw together to the male screw, and the coupling ring has an engaging portion that engages with an engaging mating portion provided on an outer peripheral surface of the barrel, wherein the gun body side connection portion and the barrel side connection portion engage in male and female fitting relationship, the barrel side connection portion configures a male side, the barrel side connection portion has a split tubular collet constructed by members separated from the barrel, the barrel side connection portion is also a mounting portion of the collet that is fastened into the gun body side connection portion as a female side, and, wherein the barrel is centered in fitting of the outer peripheral surface having the tapered shape and the movable shape.

2. The gun according to claim 1, wherein the mounting portion of the collet has an elongated slit in a direction of a central axis of the barrel, and a direction of the slit coincides with a direction of a split tubular portion of the collet.

* * * * *